United States Patent [19]

Kalvinskas et al.

[11] 4,325,707

[45] Apr. 20, 1982

[54] COAL DESULFURIZATION BY AQUEOUS CHLORINATION

[75] Inventors: John J. Kalvinskas, South Pasadena; Nick Vasilakos, Pasadena; William H. Corcoran, San Gabriel; Karel Grohmann, San Dimas; Naresh K. Rohatgi, West Covina, all of Calif.

[73] Assignee: California Institute of Technology, Pasadena, Calif.

[21] Appl. No.: 156,790

[22] Filed: May 12, 1980

[51] Int. Cl.[3] ..... C10L 9/02

[52] U.S. Cl. ..... 44/1 SR; 201/17

[58] Field of Search ..... 44/1 SR; 201/17; 423/568

[56] References Cited

U.S. PATENT DOCUMENTS

| | | | |
|---|---|---|---|
| 887,145 | 5/1908 | Stoner | 201/17 |
| 2,205,410 | 6/1940 | Howard | 208/241 |
| 3,998,604 | 12/1976 | Hinkley | 44/1 R |
| 4,081,250 | 3/1978 | Hsu et al. | 44/1 SR |
| 4,118,200 | 10/1978 | Kruesi | 44/1 SR |
| 4,169,710 | 10/1979 | Jensen | 44/1 SR |

*Primary Examiner*—Carl F. Dees

*Attorney, Agent, or Firm*—Poms, Smith, Lande & Rose

[57] ABSTRACT

A method of desulfurizing coal is described in which chlorine gas is bubbled through an aqueous slurry of coal at low temperature below 130 degrees C., and at ambient pressure. Chlorinolysis converts both inorganic and organic sulfur components of coal into water soluble compounds which enter the aqueous suspending media. The media is separated after chlorinolysis and the coal dechlorinated at a temperature of from 300 degrees C. to 500 degrees C. to form a non-caking, low-sulfur coal product.

9 Claims, 2 Drawing Figures

COAL DESULFURIZATION BY AQUEOUS CHLORINATION

DESCRIPTION

Origin of the Invention

The invention described herein was made in the performance of work under a NASA contract and is subject to the provisions of Section 305 of the National Aeronautics and Space Act of 1958, Public Law 83-568 (72 Stat 435; 42 USC 2457)

Technical Field

The present invention relates to desulfurization of coal and carbonaceous substances and, more particularly, to a low temperature process for removing sulfur from coal.

Background Art

The U.S. reserve of coal is about 3 trillion tons. Although the most abundant (80%) fossil fuel in America is coal, the U.S. consumption pattern is quite a reversal of form in terms of utilization, with coal representing only 17%, oil and gas about 78%.

The demand for all fossil fuels combined is expected to double by the year 2000, even with increasing the use of nuclear power. While the domestic supply of crude oil and natural gas is not likely to keep pace with the energy demand, coal can play an important role in filling such a gap and thus reduce the requirements for imported supplies of oil and gas.

Coal, the fossilized plant life of prehistoric times, contains various amounts of sulfur due to the nature of its origin. Under most existing commercial technology, the generation of electricity from coal poses environmental problems because of sulfur oxides and particulate emissions. Since most of the coals in this country, particularly the Eastern and Midwestern coals, have high sulfur content (>2%) there is a need for an economical process of converting high sulfur (2%) coals to clean fuel (<1.2 lbs of $SO_2$ emission per million Btu by EPA standard) in order to utilize coal as a source of energy without causing serious air pollution. So the need for converting massive coal reserves to clean-burning solid fuel, liquid fuel and pipeline quality gas is self-evident. If the vast coal reserve is converted to clean fuel, it can supply most of the energy needs of the United States for the next three centuries.

At the present time, about one-half of the electric power in the United States is generated from natural gas and petroleum; most of the other half is from coal. If the coal is converted to clean fuel for electric utilities, petroleum and natural gas would be released for other essential uses, especially as a starting material for the synthetic rubber and plastics industry.

Sulfur in coal occurs in two types, generally in approximately equal amounts of inorganic sulfur primarily as pyrites with minor amounts of sulfates and of organic sulfur in the forms of thiophene, sulfide, disulfide and mercaptan chemically bound in the organic structure of coal.

The sulfur oxides in the combustion gases of coal can be removed by stack gas scrubbing methods but those are expensive processes and produce large amounts of sludge. Hydrodesulfurization processes which remove sulfur from the fuel before combustion are effective. They are used extensively in petroleum desulfurization and many coal conversion processes under development. However, they are also expensive due to the cost of hydrogen and severe operating conditions required.

Physical separation methods can only remove the inorganic sulfur. Other desulfurization schemes under investigation such as TRW Meyers' process and Battelle Hydrothermal Coal Process are either primarily for inorganic sulfur removal or are operated at high temperature and pressure resulting in high process cost and in the physical disintegration of the coal.

A promising new process utilizing chlorine for removing organic and inorganic sulfur is described in U.S. Pat. No. 4,081,250. The three-stage process includes an initial room temperature chlorine treatment of coal slurry suspended in solvent/water media. After chlorinolysis a batch hydrolysis and solvent recovery is carried out. Finally, dechlorination at 300 degrees C. to 450 degrees C. yields a desulfurized coal product. This process requires use of a chlorine resistant solvent such as methyl chloroform which is recovered by steam distillation. Operating experience has shown that sizable losses of solvent inherently occur for various reasons which may include physical absorption of solvent on solid and/or tarry residues and also chemical hydrolysis of methyl chloroform. Furthermore, methyl chloroform is a precursor to human carcinogens and may be damaging to the ozone layer. Methyl chloroform may be unstable and hydrolyze under the conditions practiced in this process. The process produces contaminated waste water which must be treated before discharge.

It was previously believed that methyl chloroform or other organic solvent was necessary to dissolve coal components and to carry the organic sulfur compounds into solution for reaction with chlorine in the solvent phase.

DISCLOSURE OF THE INVENTION

It has now been discovered that organic solvent is not necessary to the desulfurization of coal by chlorine and that all that is required is a minimum amount of liquid medium to carry chlorine which penetrates the coal particle and reacts with the sulfur compounds. An aqueous, solvent-free carrier is equally effective, if not, superior medium for the chlorinolysis desulfurization reaction.

The aqueous chlorinolysis process does not require a separate hydrolysis step thus eliminating the capital cost of a separate vessel, process-water cost and clean-up of the waste leaching water. Furthermore, distillation is not required to recover the solvent again resulting in a considerable savings in capital equipment and energy. Large quantities of coal can be readily handled and treated in a single reactor vessel and multipurpose filter-dechlorinator. The use of costly solvent potentially hazardous to operating personnel and to the environment is eliminated. The process can be operated at ambient conditions and the agitation of an aqueous coal slurry in a pipelines may be suitable for practice of the chlorinolysis step of the process.

Chlorinolysis produces improved feedstock for combustion and gasification operations as the final treated coal is rendered completely non-caking and non-swelling. The organic sulfur removal is a significant advantage of this process. Being chemically bound to the organic structure of coal this sulfur is most difficult to remove without incurring high process cost. The desulfurization process of this invention can be used as a pretreatment step before combustion or gasification.

The processing scheme is simple and is compatible with current coal processing technologies. Furthermore, no feeding or filtration problems are expected. Since this coal desulfurization process is at atmospheric pressure and mostly at low temperature the process cost is expected to be much lower than other desulfurization schemes.

These and other features and attendant advantages of the invention will become readily apparent as the invention becomes better understood by reference to the following detailed description when considered in conjunction with the accompanying drawings.

DETAILED DESCRIPTION OF THE INVENTION

Figure 1:
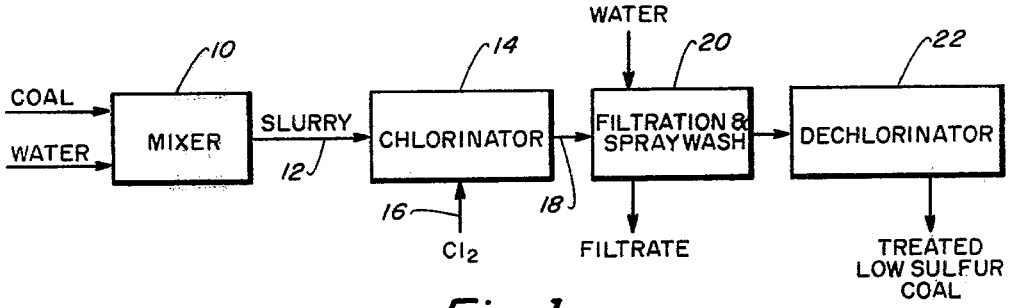
FIG. 1 is a schematic and block diagrammatic view of a process and system for desulfurizing coal in accordance with this invention.

As shown in FIG. 1, pulverized coal is mixed with water in mixing apparatus 10 to form an aqueous coal slurry 12 containing from 15 to 60% by weight of coal preferably about 20 to 40% by weight. The fine size coal and aqueous suspending media provide efficient access for chlorine to the coal particles in chlorinator 14. Chlorine is added continuously through line 16. The chlorine is provided in a stoichiometric ratio of 3.5 to 4.0 moles of chlorine per mole of total sulfur. The particular amount added to the coal slurry depends on the size of the coal, duration of chlorination, chlorine injection rate, temperature and amount of sulfur in the coal. Typically, from 10% to 50% by weight of chlorine is added to high sulfur coal containing it least 2% total sulfur. The chlorinated coal is delivered through line 18 through separation means 20 which can be a filter or centrifuge or like device. The separated coal can be washed with water in the device 20. The washed coal is then delivered to dechlorination unit 22 through line 24 and is heated to a temperature of from 300 degrees C. to 450 degrees C. to yield a treated, low-sulfur coal.

Chlorinonlysis is conducted at a low temperature generally below 130 degrees C. preferably from ambient, e.g. 20 degrees C. to 100 degrees C. The chlorinolysis step can be operated at ambient atmospheric pressure or at elevated pressure of from 1 to 5 atmospheres. The coal slurry should be agitated during chlorinolysis. Chlorine dispersion into the coal slurry is significantly improved by use of good agitation. During chlorinolysis the pyritic and organic sulfur in the coal is converted to sulphate sulfur which dissolves in the aqueous media. Effective desulfurization is achieved at a chlorine flow rate of from 1.0 to 50 SCF per hour, per kilogram of coal usually about 3 to 25 SCF per hour per kilogram of coal in about 0.1 to 3 hours. The coal slurry may remain in the reactor or in a holding tank following chlorination to complete hydrolysis and leaching of the soluble sulfate reaction products into the aqueous media. The hydrolyzed coal is then dechlorinated to a chlorine content below 1.0%, preferably at 0.1% by heating the coal with inert gas to a temperature above 300 degrees C. The hydrogen chloride evolved during chlorination and dechlorination can be recovered as a valuable byproduct or it can be converted to chlorine gas for recycle by a commercial process such as the KEL-CHLOR process developed by M. W. Kellogg Company.

The desulfurization process is capable of desulfurizing diverse types of organic material in addition to coal such as petroleum, oil shale, industrial waste, particularly black liquor residue from sulfate or sulfite pumping. The coals suitable for desulfurization treatment in accordance with this invention can be bituminous, subbituminous or lignite containing at least 0.2% sulfur. Pulverization aids the chlorinolysis reaction rate. Typically, the coal will be pulverized and classified to 40 to 325 mesh, usually from 100 to 200 mesh.

Figure 2:
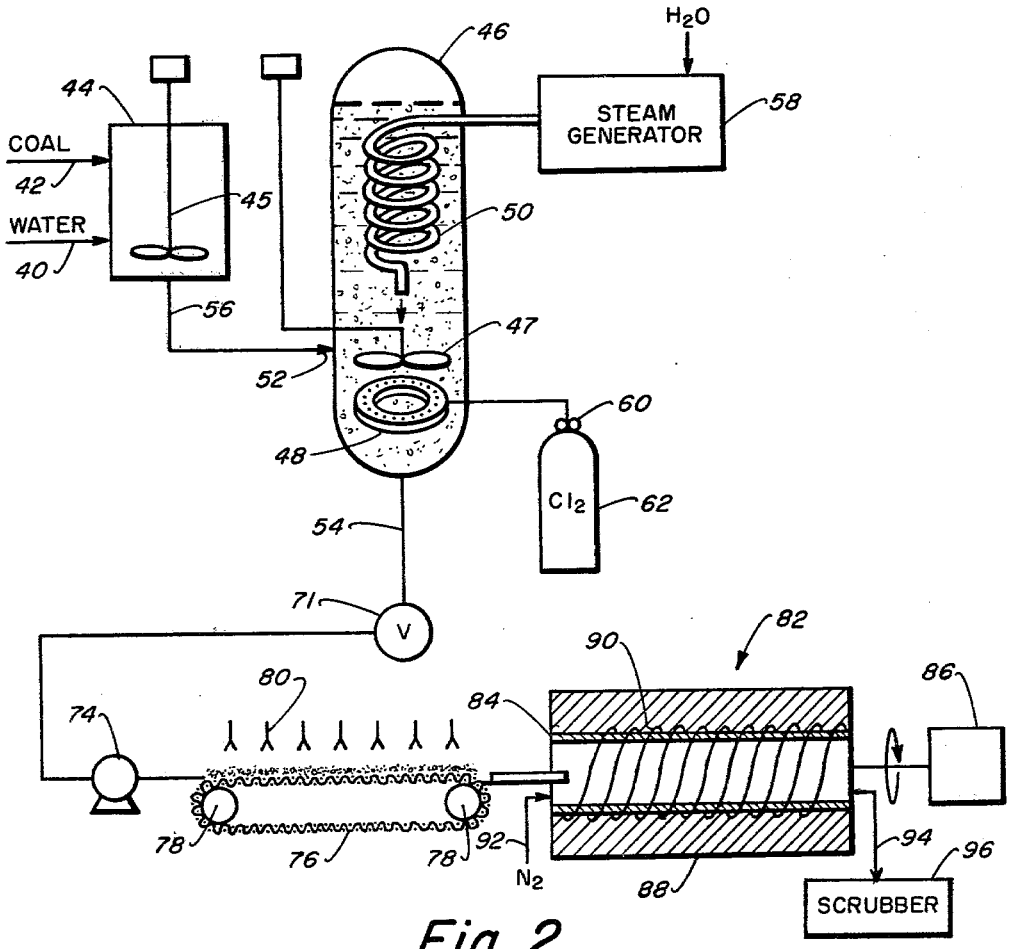
FIG. 2 is a more detailed schematic view of an apparatus for practicing the process of the invention.

A more detailed process is illustrated in FIG. 2. Water and powdered coal are added through lines 40, 42 respectively to slurry tank 44 containing mixing element 45. Chlorinolysis reactor 46 contains a chlorine diffuser such as a sparger ring or fritted diffuser element 48, an internal steam coil 50 having an outlet exhausting into the reactor, an agitator 47 and a slurry inlet 52 and a slurry outlet 54. The slurry is transferred through line 56 to inlet 52. Steam generator 58 is operated to deliver steam to the coil 50 to maintain reaction temperature, suitably at 65 degrees C. ±5 degrees and the valve 60 on chlorine supply cylinder 62 is activated to deliver the required amount of chlorine to the slurry in reactor 46.

After chlorinolysis has proceeded to completion, the slurry is transported through line 54 by means of pump 74 when valve 71 is open to continuous separation and wash station such as a porous loop belt or screen 76 driven by rollers 78. The coal can be washed by means of spray heads 80 mounted over the screen 76. The dewatering of the slurry can be assisted by vacuum, not shown. The washed slurry is then fed to a continuous dechlorinator 82 containing cylinder 84 which is rotated by drive means 86 and is externally heated by electrical heating coil 90 to a uniform temperature form 350 degrees C. to 450 degrees C. for 10 to 60 minutes. The heated cylinder 90 is mounted in a sleeve of insulation 84 such as refractory material. The cylinder is purged to remove HCl by means of a flow of inert gas 92 such as nitrogen. The purge gas is removed through line 94 to a scrubber 96 containing a HCl absorbent such as caustic. Examples of practice follow:

EXAMPLE 1

A sample of Illinois No. 6 Knox coal coded as Raw Coal PSOC 190 was analyzed by ASTM-approved methods. Moisture content was 16 wt.%. Total sulfur was 2.49%; pyr. S. was 0.16; organic sulfur was 1.53% and sulf. S was 0.80%.

Then 11.6 grams of PSOC-190 coal was ground to −100 to +200 mesh, admixed with 350 cc of water, chlorinated at 0.2 SCFH of chlorine for 60 minutes in a stirred reactor equipped with a reflux condenser, dry ice cold trap and sodium hydroxide scrubber. The chlorination temperature was 60 degrees C. with a miximum temperature rise during the first ten minutes of reaction of 5 degrees C. The treated coal, after chlorination, was filtered and dried under vacuum up to 95 degrees C. for two hours. No hydrolysis or dechlorination was attempted. Analysis of the product showed the following:

| | |
|---|---|
| Total sulfur removal | 47% |
| (Organic + pyritic) S removal | 29% |

EXAMPLE 2

When chlorinolysis was repeated under the conditions of Example 1 with methyl chloroform as the suspending medium, the total sulfur removal was only 17% and (Organic+pyritic) S removal was 27%. It is to noted that the presence of 16% moisture in the feed coal would provide some water content during chlorinolysis.

EXAMPLE 3

When chlorinolysis was repeated under the conditions of Example 1 an equal mixture of water and chloroform as the suspending medium the total sulfur removal was only 12% and the (Organic+pyritic) S removal was 26%.

Thus, in these small batch experiments an organic solvent-free, aqueous medium provides significantly improved desulfurization.

A further set of comparison runs were conducted as follows.

100 grams of coal sample ground to −100 to 200 mesh, 200 grams of solvent, 30 grams of water, chlorinated at 0.5 SCFH of $Cl_2$ for 45 minutes in a stirred 500 ml. flask equipped with a reflux condenser, dry ice cold trap and gas holder over water. Methyl chloroform was distilled from the sample after chlorination was ended and water had been added. Sample was washed to remove water soluble sulfate compounds, dried and then dechlorinated at 400 degrees C. for 30 minutes. Only a 2 to 4 gram sample was dechlorinated at a time. Chlorination was conducted at a water bath temperature of 65 degrees C. With the exothermic heat of reaction, the reaction temperature was probably somewhat higher but was confined to 74 degrees C. maximum, i.e., B.P. of methyl chloroform. The data is presented in the following table.

2 kilogram batches of coal at a water to coal ratio of 2/1 at temperatures of 50 to 150 degrees C. and pressures of 0 to 100 psig using gaseous chlorine injected into the coal slurry. The coal-water slurry is dewatered and washed in a vacuum filter and then dechlorinated by an electrically heated Lindberg furnace equipped with a 5-inch diameter by 5 feet long rotary tube with a 2 kilogram coal capacity.

The reactor was leak tested under nitrogen pressure, purged with nitrogen and charged with two kilograms of coal (100 to +200 mesh, weight corrected for coal moisture) and four kilograms of solvent (either methylchloroform or water). In most runs, the reactor off-gas valve to the reflux condenser was closed with injected chlorine confined to the coal slurry and ullage space in the reactor. Agitation was set in the first few runs at 275 RPM based on Chemineer design standards. With the majority of runs agitation was set at 565 RPM, the maximum agitator speed. Direct steam injection provided reactor preheat to the desired operating temperature in 20 to 30 minutes. Chlorine flow was then initiated to the reactor and adjusted to the prescribed flow rate. For operation at elevated pressures, a high initial flow rate of chlorine was set to establish the desired pressure and then reduced to the desired flow rate and/or flow rate compatible with maintaining the pressure level. Cooling water flow was adjusted to control the reactor temperature at prescribed levels. Coal slurry samples were obtained at 15, 30, 45 and in some cases 90 minutes. Samples were approximately 100 grams obtained close to the wall and near the reactor bottom. Stirring was sufficiently intense to insure a representative coal slurry sample.

Chlorine injection was initially through a ¼-inch stainless steel tube located to the side and near the reactor bottom, beneath the turbine impeller. With high chlorine flow rates (>20 SCFH) and poor chlorine diffuser injection, there was a rapid reactor pressurization, i.e., 20–30 psig in <5 minutes. A reduced chlorine flow rate (10 SCFH) and good chlorine diffuser injection provided relatively little reactor pressurization (i.e., <5 psig) in 30 to 45 minutes until the coal slurry was apparently saturated with chlorine. At that point,

TABLE 1

| | | Raw Coal (%) | Treated Coal (%) | Sulfur Removal (%) |
|---|---|---|---|---|
| Example 4 | | | | |
| Coal PSOC 190 [Illinois #6] | Total S | 3.05 | 1.43 | 53 |
| Control Run | Pyr. S | 1.05 | 0.05 | 95 |
| Methyl chloroform solvent | Org. S | 1.90 | 1.38 | 27.4 |
| $H_2O$/Coal-0.3 | Sulfate S | 0.10 | 0 | — |
| Example 5 | | | | |
| Coal PSOC 190 [Illinois #6] | Total S | 3.05 | 1.59 | 48 |
| Methyl chloroform solvent | Pyr. S | 1.05 | 0.07 | 93.5 |
| $H_2O$/Coal - 0 | Org. S | 1.90 | 1.52 | 20.0 |
| Time: 45 minutes | Sulfate S | 0.10 | 0 | — |
| Example 6 | | | | |
| Coal PSOC 219 [Kentucky #4 Bitum] | | | | |
| Control Run | | | | |
| Methyl chloroform solvent | Total S | 2.56 | 0.91 | 65 |
| $H_2O$/Coal = 0.3 | Pyr. S | 1.4 | 0.15 | 89.5 |
| Time: 45 minutes | Org. S | 1.08 | 0.76 | 29.6 |
| | Sulfate S | 0.08 | 0 | — |
| Example 7 | | | | |
| Coal PSOC 219 [Kent. #4 Bitum.] | Total S | 2.56 | 0.90 | 65 |
| Water as solvent | Pyr. S | 1.4 | 0.23 | 83.5 |
| Methyl chloroform = 0 | Org. S | 1.08 | 0.67 | 38.0 |
| $H_2O$/Coal = 2 | Sulfate S | 0.08 | 0 | — |
| Time: 45 Minutes | | | | |

As can be observed from Table 1, the run (Example 7) utilizing water as the suspending and leaching medium provided the highest organic sulfur removal and equal total sulfur removal to the control run using anhydrous methyl chloroform (Example 5), or methyl chloroform-water mixtures (Example 4 and 6).

Further experiments were conducted in a bench scale, acid brick lines reactor providing chlorination of rapid reactor pressurization occurred unless chlorine flow was stopped or sharply reduced. In some runs, chlorine flow rates had to be substantially reduced form initial values at the start of the reaction in order to avoid over pressurization with a closed reactor system. In some cases a continuous vent of off-gases, i.e. chlorine, was maintained to allow continued chlorine injection into the coal slurry. With fritted glass diffusers, problems were experienced with plugging by coal tar after 20 to 30 minutes of reaction time. This problem was also encountered when a teflon diffuser tube was used with hole sizes less than 1/32-inch. Chlorine dispersion into the coal slurry was also found to be improved by increasing agitator speed form the initial setting of 275 RPM to 565 RPM.

After chlorination, reactor pressure is reduced by venting reactor gases through the reflux condenser, gas holder and to the caustic scrubber. With methylchloroform in the reactor, four kilograms of water are added and direct steam injection is used to heat the reactor and flash distill the methylchloroform to the condenser and solvent recovery tank. Steam is added until the temperature rise goes from 74 degrees C. to approximately 100 degrees C., indicating that methylchloroform removal is complete. Hydrolysis is considered to be essentially complete during the chlorination reaction since water is present from the steam condensate in reactor preheat and coal moisture. Flash distillation of methylchloroform normally takes 45 to 60 minutes. After solvent recovery, the coal-water slurry is cooled, removed through the bottom drain into a hooding tank and transferred to the batch vacumn filtration unit.

With water as the solvent, the flash distillation step is circumvented. To provide comparable reactor operating conditions between methylchloroform and water runs, some water solvent runs were made with the coal slurry held in the reactor for one hour at temperatures of 65 to 100 degrees C. after the chlorination. Thus, if additional reaction or leaching of the coal was possible during the additional holdup time, this would be indicated by comparing analytical results of the processed bulk samples and samples withdrawn prior to the holdup period.

The coal-water slurry is added to the batch vacuum filtration unit. An exhaust blower provides 20 to 30 inches of water column vacuum. A water spray manually applied provides a displacement water wash of the filter cake with water/coal addition at 2/1.

Coal samples were removed form the vacuum filter and dried in a vacuum oven overnight at 100 degrees C. A majority of sulfur analyses were performed on the dried but undechlorinated coal samples. Some sulfur form analyses were performed in duplicate on dechlorinated and undechlorinated samples. Analytical results were found to be comparable. Since the dechlorinator was not available until late in the program, a majority of chlorinated, washed, dried coals were stored for up to 3 months in closed glass containers before dechlorination.

Dechlorination of the coal was obtained in a Lindberg furnace equipped with a rotary 5-inch diameter by 5-foot long tube. The furnace and tube were preheated to the operating temperature of 400 degrees C., flushed with nitrogen and charged with 2 kilograms of coal. Approximately 30 minutes were required to heat the coal charge to 400 degrees C. while maintaining a nitrogen purge of 30 SCFH. The coal is then held at 400 degrees C. for an additional 30 to 60 minutes. Tube rotation was maintained at 4 RPM. After dechlorination, furnace heat was shut down while maintaining the nitrogen purge. After 30 to 60 minutes of cooling, the coal was removed and stored in a closed glass container.

The major portion of coal analyses including sulfur forms (pyritic, sulfate and total sulfur), ultimate analyses, proximate analyses and trace element analyses of both raw and treated coal samples were conducted according to the ESCHKA method for total sulfur analysis and ASTM approved procedures for pyritic and sulfate sulfur with organic sulfur determined by difference. A majority of coal samples were analyzed before dechlorination. A Leco acid-base analyzer was used to provide immediate total sulfur analyses after completion of each test run. Because of potential chlorine interference, 2–4 gram samples of the treated coal were first dechlorinated in a laboratory unit before Leco sulfur analyses. Water filtrate solutions form the chlorinator and vacuum filter were analyzed for sulfates, chlorides, iron and trace elements.

The 5 coals selected for the bench-scale batch reactor tests are listed in Table 2 with attendant analyses for organic, pyritic and total sulfur. They are bituminous coals obtained from Ohio, Illinois and Kentucky. Five tons each of PSOC 276 and PSOC 282 were obtained directly form the mine site. Coal samples of PSOC 219 and 026 were obtained form the Penn State Coal Bank during the laboratory scale test program. Island Creek Coal was obtained form DOE. PSOC 282 represents a washed coal with an original unwashed sulfur content of 2.2 weight percent, versus 1.62 weight percent ottal sulfur for the washed coal. Preliminary coal desulfurization data are reported for only four of the coals with the Island Coal results pending rom the analytical laboratory.

A total of 44 test runs were conducted with 15 runs on coal PSOC 276, 19 runs on coal PSOC 282, 2 runs on PSOC 219, 3 runs on PSOC 026 and 5 runs on Island Creek Coal (Western Kentucky, Union County #9 Seam). Only a portion of the analytical data are available for presentation at this time.

TABLE 2

| ERDA PSOC Number | Seam, County and State | Rank | Ash Content (Wt. %) | Sulfur Content, Wt. % Organic | Pyritic | Total |
|---|---|---|---|---|---|---|
| 276 | OHIO, No. 8, Harrison OHIO | HVA, Bit. | 11.2 | 1.19 | 2.67 | 3.89 |
| 282 | Ill. No. 6, Orient No. 6 Mine, Washed* | Bit. | 6.7 | 0.74 | 0.78 | 1.62 |
| 219 | Kentucky No. 4, Hopkins, Ky. | HVA, Bit. | 8.1 | 0.77 | 0.74 | 2.14 |
| 026 | Ill. No. 6, Saline, Ill. | HVC, Bit. | 10.8 | 1.62 | 4.20 | 3.47 |
| Island Creek | Western Kentucky, Union County No. 9 Seam | Bit. | 12.6 | 1.53 | 1.97 | 3.54 |

*Unwashed Coal Had 2.2 wt. % Total sulfur, 22 wt. % ash.

A smmary of operating conditions for the chlorinolysis reaction and attendant coal desulfurization data for organic, pyritic and total sulfur is presented, Table 3. Desulfurization data are presented for reaction times of 15, 30, 45 and 90 minutes with methylchloroform and water as solvents. Operating conditions ranged from: 63 to 130 degrees C., 0–60 psig, chlorine feed rates of 5 to 24 SCFH. Methylchloroform runs were generally confined to 65 degrees C. and water runs were at 65 to 130 degrees C.

The bench scale batch reactor was operated under the following conditions:

Coal, 2 kilograms, −100 to +200 mesh; solvent to coal, 2/1; preheat steam condensate added to reactor, 300–500 grams at 65 degrees C., 2500 grams at 130 degrees C., additional water in solvent runs zero except for 160 grams in run 7 and moisture in coal; agitator speed runs (1–6) at 275 rpm, runs (7–44) at 530 rpm: Chlorine injection, runs (1–7) $\frac{1}{4}$ inch tubing, runs (8–19) fritted glass diffuser, runs (20–44) $\frac{1}{4}\times\frac{1}{2}$ inch diameter Teflon tubing drilled with $\frac{1}{4}$ to $\frac{1}{8}$-inch holes, nominal size $\frac{1}{8}$-inch. The data on coal desulfurization by low temperature chlorinolysis follows in Table 3.

TABLE 3

| Run and Date | Operating Conditions: Temp (°C.) | Pressure (psig) | Chlorine Feed (SCFH) | Chlorine Feed (kg) | Time (Minutes)/Residual Sulfur (Wt. %): ORG | PYR | TOT. | 15 ORG | 15 PYR | 15 TOT. | 30 ORG | 30 PYR | 30 TOT. | 45 ORG | 45 PYR | 45 TOT. | 90 ORG | 90 PYR | 90 TOT. |
|---|---|---|---|---|---|---|---|---|---|---|---|---|---|---|---|---|---|---|---|
| Coal PSOC 276 With Methyl Chloroform as Solvent | | | | | | | | | | | | | | | | | | | |
| 7-5/24/79 | 63 | 1–3 | 19 | 1.32 | 1.19 | 2.67 | 3.89 | 1.35 | 1.03 | 2.38 | 1.24 | 0.62 | 1.92 | 1.20 | 0.50 | 1.71 | | | |
| 0-6/5/79 | 65 | 9–13 | 10 | 0.68 | | | | 1.29 | 1.51 | 2.80 | 1.41 | 0.99 | 2.40 | 1.31 | 0.64 | 1.95 | | | |
| 1-5/4/79 | 65 | 1–27 | 15 | 1.05 | | | | 1.31 | 1.19 | 2.50 | 1.28 | 0.65 | 1.92 | 1.32 | 1.37 | 1.69 | | | |
| 2-5/8/79 | 65 | 12–29 | 15 | 1.00 | | | | 1.29 | 0.78 | 2.07 | — | — | — | — | — | — | | | |
| 3-5/10/79 | 65 | 1–50 | 15 | 1.00 | | | | 1.29 | 1.10 | 2.39 | 1.27 | 0.58 | 1.85 | 1.22 | 0.48 | 1.70 | | | |
| Average | 65 | | | | | | | 1.31 | 1.12 | 2.43 | 1.30 | 0.71 | 2.02 | 1.26 | 0.50 | 1.76 | | | |
| Removal (%) | 65 | | | | | | | −10.1 | 58.0 | 37.5 | −9.2 | 73.4 | 48.1 | −5.9 | 81.3 | 54.7 | | | |
| Coal PSOC 276 With Water as Solvent | | | | | | | | | | | | | | | | | | | |
| 4-5/15/79 | 65 | 1–42 | 11 | 0.75 | 1.19 | 2.67 | 3.89 | 1.16 | 1.79 | 2.95 | 1.40 | 1.21 | 2.62 | 1.30 | 1.19 | 2.49 | | | |
| 8-5/30/79 | 65 | 1–5 | 11 | 0.78 | | | | 1.24 | 1.53 | 2.78 | 1.32 | 0.98 | 2.31 | 1.36 | 0.66 | 2.02 | | | |
| 9-6/1/79 | 65 | 2–5 | 11 | 0.78 | | | | 1.33 | 1.80 | 3.13 | 1.29 | 1.58 | 2.88 | 1.35 | 1.08 | 2.43 | | | |
| 11-6/7/79 | 77–89 | 4–38 | 16 | 0.36 | | | | 1.21 | 2.04 | 3.26 | — | — | — | — | — | — | — | — | — |
| 12-6/8/79 | 90 | 1–10 | 13 | 0.88 | | | | 1.30 | 2.01 | 3.32 | 1.37 | 1.51 | 2.88 | 1.49 | 0.98 | 2.48 | | | |
| 5-5/18/79 | 99 | 1–38 | 6 | 0.39 | | | | 1.17 | 2.00 | 3.17 | 1.34 | 1.24 | 3.08 | 1.34 | 1.50 | 2.84 | | | |
| 6-5/21/79 | 102 | 1–48 | 22 | 1.47 | | | | 1.21 | 1.53 | 2.74 | 1.27 | 1.10 | 2.37 | 1.22 | 0.92 | 2.14 | | | |
| 16-6/18/79 | 123 | 26–35 | 9 | 0.79 | | | | 1.37 | 1.31 | 2.68 | 1.38 | 1.21 | 2.59 | 1.26 | 1.07 | 2.32 | 1.40 | 0.97 | 2.37** |
| 13-6/12/79 | 125 | 32–47 | 6 | 0.37 | | | | 1.21 | 1.47 | 2.68 | 1.31 | 1.28 | 2.58 | 1.39 | 1.24 | 2.63 | | | |
| 14-6/13/79 | 128 | 23–45 | 15 | 0.99 | | | | 1.33 | 1.48 | 2.81 | 1.29 | 1.05 | 2.33 | 1.26 | 1.12 | 2.38 | | | |
| Average | | | | | | | | 1.25 | 1.70 | 2.95 | 1.33 | 1.29 | 2.63 | 1.33 | 1.08 | 2.41 | | | |
| Removal (%) | | | | | | | | −5.0 | 36.3 | 24.2 | −11.8 | 51.7 | 32.4 | −11.8 | 59.5 | 38.0 | | | |
| Coal PSOC 282 With Methyl Chloroform as Solvent | | | | | | | | | | | | | | | | | | | |
| 27-7/20/79 | 62 | 4–20 | 16 | 1.05 | 0.74 | 0.78 | 0.78 | 0.70 | 0.61 | 1.37 | 0.63 | 0.57 | 1.26 | 0.56 | 0.62 | 1.28 | 0.55 | 0.66 | 1.21 |
| 17-6/29/79 | 65 | 0–11 | 5 | 0.36 | | | | 0.53 | 0.54 | 1.10 | 0.38 | 0.48 | 0.95 | 0.53 | 0.47 | 1.05 | | | |
| 21-7/10/79 | 65 | 6–40 | 20 | 1.32 | | | | 0.64 | 0.45 | 1.17 | 0.48 | 0.46 | 0.99 | 0.32 | 0.55 | 0.94 | 0.13 | 0.69 | 1.00 |
| 23-7/13/79 | 65 | 0–45 | 22 | 1.51 | | | | 0.59 | 0.48 | 1.17 | 0.36 | 0.54 | 1.02 | 0.17 | 0.71 | 0.99 | | | |
| 25-7/18/79 | 63 | 0–7 | 8 | 0.52 | — | — | — | — | — | — | — | — | — | — | — | — | | | |
| 19-6/25/79 | 85 | 2–18 | 16 | 1.10 | | | | 0.71 | 0.51 | 1.22 | 0.54 | 0.45 | 1.05 | 0.41 | 0.52 | 0.99 | | | |
| Average | | | | | | | | 0.63 | 0.52 | 1.21 | 0.48 | 0.50 | 1.05 | 0.40 | 0.57 | 1.05 | 0.34 | 0.67 | 1.10 |
| Removal (%) | | | | | | | | 14.9 | 33.3 | 25.3 | 35.1 | 35.9 | 35.2 | 45.9 | 27.0 | 35.2 | 54.0 | 14.1 | 32.1 |
| Coal PSOC 282 With Water as Solvent | | | | | | | | | | | | | | | | | | | |
| 15-6/15/79 | 70 | 1–4 | 13 | 0.87 | 0.74 | 0.78 | 1.62 | 0.71 | 0.61 | 1.32 | 0.74 | 0.41 | 1.15 | 0.73 | 0.35 | 1.07 | | | |
| 18-6/22/79 | 88 | 2–7 | 12 | 0.80 | | | | 0.76 | 0.54 | 1.29 | 0.71 | 0.42 | 1.14 | 0.71 | 0.40 | 1.11 | | | |
| 22-7/12/79 | 90 | 0–39 | 12 | 1.66 | | | | 0.75 | 0.50 | 1.26 | 0.73 | 0.42 | 1.16 | 0.71 | 0.40 | 1.11 | 0.55 | 0.37 | 0.91 |
| 24-7/17/79 | 130 | 20–53 | 10 | 0.65 | | | | 0.79 | 0.54 | 1.33 | 0.74 | 0.45 | 1.18 | 0.80 | 0.44 | 1.24 | 0.67 | 0.40 | 1.06 |
| Average | | | | | | | | 0.75 | 0.55 | 1.30 | 0.73 | 0.42 | 1.16 | 0.74 | 0.40 | 1.13 | 0.61 | 0.38 | 0.98 |
| Removal (%) | | | | | | | | −1.3 | 29.5 | 19.7 | 1.3 | 46.1 | 28.4 | 0.0 | 48.7 | 30.2 | 17.6 | 51.2 | 39.5 |
| Coal PSOC 219 With Methyl Chloroform as Solvent | | | | | | | | | | | | | | | | | | | |
| 28-7/23/79 | 65 | 3–40 | 10 | 1.40 | 0.77 | 0.74 | 2.14 | 0.54 | 0.49 | 1.16 | 0.53 | 0.42 | 1.10 | 0.32 | 0.58 | 0.97 | 0.06 | 0.73 | 0.96 |
| Removal (%) | | | | | | | | 29.9 | 33.8 | 45.8 | 31.2 | 43.2 | 48.6 | 58.4 | 21.6 | 54.7 | 92.2 | 1.4 | 55.1 |
| Coal PSOC 219 With Water as Solvent | | | | | | | | | | | | | | | | | | | |
| 29-7/25/79 | 65 | 6–37 | 21 | 1.43 | 0.77 | 0.74 | 2.14 | 0.83 | 0.39 | 1.34 | 0.86 | 0.32 | 1.28 | 0.80 | 0.20 | 1.09 | 0.86 | 0.14 | 1.00 |
| Removal (%) | | | | | | | | −7.8 | 47.3 | 37.4 | −11.7 | 56.7 | 40.2 | −3.9 | 72.8 | 49.1 | −11.7 | 81.1 | 53.3 |
| Coal PSOC 026 With Methyl Chloroform as Solvent | | | | | | | | | | | | | | | | | | | |
| 31-7/29/79 | 90 | 40 | 20 | 1.38 | 1.74 | 1.10 | 3.53 | 1.46 | 0.48 | 2.11 | 1.34 | 0.37 | 1.85 | 1.31 | 0.49 | 1.78 | 0.88 | 0.69 | 1.74 |
| Removal (%) | | | | | | | | 9.9 | 60.0 | 39.2 | 17.3 | 69.2 | 46.7 | 19.1 | 59.2 | 48.7 | 45.7 | 42.5 | 49.8 |
| Coal PSOC 026 With Water as Solvent | | | | | | | | | | | | | | | | | | | |

TABLE 3-continued

| Run and Date | Operating Conditions: Temp (°C.) | Pressure (psig) | Chlorine Feed (SCFH) | Chlorine Feed (kg) | Time (Minutes)/Residual Sulfur (Wt. %): ORG | PYR | TOT. | 15 ORG | 15 PYR | 15 TOT. | 30 ORG | 30 PYR | 30 TOT. | 45 ORG | 45 PYR | 45 TOT. | 90 ORG | 90 PYR | 90 TOT. |
|---|---|---|---|---|---|---|---|---|---|---|---|---|---|---|---|---|---|---|---|
| 30-7/16/79 | 65 | 30 | 19 | 1.26 | | | | 1.59 | 0.65 | 2.34 | 1.69 | 0.37 | 2.06 | 1.69 | 0.20 | 1.89 | 1.54 | 0.13 | 1.31 |
| 32-7/30/79 | 90 | 35 | 24 | 1.62 | 1.50 | 1.31 | 3.41 | 1.81 | 0.62 | 2.42 | 1.72 | 0.32 | 2.04 | 1.69 | 0.23 | 1.92 | | | |
| Average | | | | | 1.62 | 1.20 | 3.47 | 1.70 | 0.63 | 2.38 | 1.70 | 0.34 | 2.05 | 1.69 | 0.21 | 1.90 | | | |
| Removal (%) | | | | | | | | −4.7 | 47.5 | 31.4 | −4.7 | 71.7 | 40.9 | −4.3 | 82.5 | 45.2 | 4.9 | 89.2 | 47.8 |

*O-Organic, P-Pyritic, T-Total
**60-minutes reaction time

Inspection of the data in Table 3 indicates no apparent correlation of coal desulfurization for any of the coals with respect to temperature, pressure and chlorine flow rates. A substantial reduction of chlorine flow into the coal slurry did reduce coal desulfurization in Run 5 when equipment failure, i.e., corrosion of the chlorine injection tube provided injection of chlorine only into the top surface layer of coal slurry and ullage space of the reactor. However, changes in gaseous chlorine injection from a ¼ inch tube opening located beneath the agitator impeller to a standard fritted glass diffuser element and finally to a Teflon tube drilled with 1/74 to ⅛-inch holes did not appear to affect the extent of desulfurization but did substantially alter the chlorine addition to the coal slurry solution. Use of chlorine injectors providing large gaseous chlorine bubbles into the coal slurry created a rapid reactor pressurization by chlorine whereas use of improved gas diffusers, smaller injection holes, provided very little reactor pressurization until an apparent coal slurry saturation with chlorine at 30 to 45 minutes. A substantial variance in temperature, pressure and chlorine flow rates existed between runs so that a substantial effect of these variables on coal desulfurization would have been evident if it existed. Reactor times of 15 and 30 minutes were sufficiently short so that kinetic effects could be observed in this operating range. A reaction time of 45 minutes provided a leveling off and/or peaking of coal desulfurization.

Sulfur forms are listed in Table 3 for individual runs. Since temperature, pressure and chlorine flow had no apparent correlation with desulfurization data, all of the runs with a given coal and given solvent (methylchloroform or water) were averaged (Table 2) and average residual sulfur forms plotted with respect to reaction time. Average sulfur reductions in addition to average sulfur residuals were also calculated for organic, pyritic and total sulfur for each of the coals and solvents and plotted.

A summary table of average sulfur removals for organic, pyritic and total sulfur is included, Table 4 for a reaction time of 45 minutes. Sulfur removals are indicated both as weight percent sulfur removal and as a percent removal of original sulfur.

The bench scale batch reactor was operated under the following conditions:

45 minute reaction time, 2 kg Coal −100 to +200 mesh, methyl chloroform runs at 65 degrees C., water runs at 65–130 degrees C., pressure at 0–60 psig; chlorine feedrate at 5 to 24 SCFH; agitator speed 275–530 rpm, live steam preheat condensate to coal, 10–20 percent at 65 degree C., 125 percent at 130 degrees C. (Ref. Table 3). The data follows.

TABLE 4

| | | Organic Sulfur Removal | | Pyritic Sulfur Removal | | Total Sulfur Removal | |
|---|---|---|---|---|---|---|---|
| Coal | Solvent | (Wt. %) | (%) | (Wt. %) | (%) | (Wt. %) | (%) |
| PSOC-276 | MC* | −0.07 | −6 | 2.17 | 81 | 2.13 | 55 |
| PSOC-276 | $H_2O$ | −0.14 | −12 | 1.59 | 60 | 1.48 | 38 |
| PSOC-282 | MC | 0.33 | 46 | 0.21 | 27 | 0.57 | 35 |
| PSOC-282 | $H_2O$ | 0 | 0.0 | 0.38 | 49 | 0.49 | 30 |
| PSOC-219 | MC | 0.45 | 58 | 0.16 | 22 | 1.17 | 55 |
| PSOC-219 | $H_2O$ | −0.03 | −4 | 0.54 | 73 | 1.05 | 49 |
| PSOC-026 | MC | 0.43 | 19 | 0.61 | 59 | 1.69 | 49 |
| PSOC-026* | $H_2O$ | 0.19 | −4 | 0.99 | 82 | 1.58 | 45 |

*Methyl chloroform

The data indicates that:

(1) No organic sulfur removal for coal PSOC 276 with an apparent (but not significant) increase in organic sulfur.

(2) Remaining coals PSOC 282,219 and 026 showed organic sulfur removal of 19 to 58 plus percent with methylchloroform and no apparent decrease in organic sulfur with water as a solvent. (Apparent contradictory laboratory scale data exists showing better organic sulfur removal with water as a solvent with coals PSOC 190 and PSOC 219 than with methylcloroform.)

(3) Apparent increases in organic sulfur are not considered significant since analytical accuracy is probably less than measured organic sulfur increases.

(4) Total sulfur removal is greater with methylchloroform as a solvent for coal PSOC 276 relative to water (55% vs. 38%). Remaining coals show slight but not significantly greater decreases of total sulfur with methylchloroform versus water. Coals PSOC 219 and 026 show approximately 50% total sulfur removal and PSOC 282 shows approximately 30 to 35% total sulfur reduction.

(5) Pyritic sulfur removals for coals PSOC 282, and 026 were greater with water, 49 to 82% versus 22 to 59% for methylchloroform aided pyritic sulfur removal relative to water.

(6) Although some apparent reductions in organic and pyriticsulfur values are indicated by extending the reaction time from 45 to 90 minutes, the apparent increased reductions in one sulfur form are apparently nullified by an apparent increase in the alternate sulfur form (organic vs. pyritic) such that the total sulfur reduction appears to be a maximum at 45 minutes. Since only partial analytical data are available, conclusions are preliminary subject to obtaining remaining data from the batch reactor chlorination.

After the treated coal slurry is flash distilled, washed and vacuum filtered, thermal dechlorination is obtained in a rotary tube, capacity 2 kilograms of coal, using a Lindberg electric furnace. Dechlorination was carried out with the electric furnace and tube preheated to 400 degrees C. Coal was then added, with 30 minutes required to heat to 400 degrees C. and an additional 30 to 60 minutes used for thermal dechlorination at 400 degrees C. with a nitrogen purge at 30 SCFH and 0.5 psig. Coal was cooled for approximately 30 to 60 minutes in the rotary tube before removal. Dechlorination data are presented for coal PSOC 276, Table 5. Treated dried coal before dechlorination showed 4–8 weight percent chlorine. After dechlorination the chlorine content was 0.5 to 0.88 weight percent. Laboratory scale data in Phase 1 glassware showed somewhat better dechlorination results. A final reduction scale data in glassware showed somewhat better dechlorination results. A final reduction of residual chlorine values to that present in the original coal or 0.1 weight percent is desired.

The batch-scale batch reactor was operated under the following conditions.

2 Kilograms chlorinated coal PSOC, 30 minutes coal preheat from 25 degrees C. to 400 degrees C., 30 minutes at 400 degrees C.; nitrogen purge, pressure=0.5 psig)

The data follows.

| Run | Before Dechlorination Cl (Wt. %) | After Dechlorination Cl (Wt. %) |
|---|---|---|
| 7 - 5/24/79 | 6.94 | 0.75 |

-continued

| Run | Before Dechlorination Cl (Wt. %) | After Dechlorination Cl (Wt. %) |
|---|---|---|
| 8 - 5/30/79 | 4.09 | 0.60 |
| 10 - 6/5/79 | 5.83 | 0.88 |
| 12 - 6/8/79 | 8.01 | 0.98 |
| Raw Coal PSOC 276 | 0.17 | — |

The bench scale batch reactor studies with 2 kilograms of coal/batch provided a broader range of pressure and temperature operating conditions than that originally explored in the laboratory scale studies. The introduction of water in lieu of methylchloroform as a solvent shows considerable promise for total sulfur removal, although organic sulfur removal by water as a solvent has only been demonstrated in lab scale work to any significant extent. Increase in operating temperature and pressure does not appear to improve coal desulfurization.

Engineering cost analysis indicates an overall process cost of $13 to $19 per ton for PSOC 219 coal containing 2.56 weight percent of total sulfur for the solvent process and at least $4 per ton less for the water process. The chlorinated coal may be solvent extracted to yield a feedstock suitable for liquifaction or gasification instead of being thermally dechlorinated. The process of this invention provides a high degree of sulfur removal under mild conditions (65 degrees C., 1 atm) using low cost reagents (water, $Cl_2$). Most of the chlorine consumed can be recovered as HCl which can be converted to chlorine. The final product is an improved feedstock for combustion, liquefaction or gasification since it is non-caking and non-swelling.

It is to be realized that only preferred and exemplary embodiments of the invention have been illustrated and that numerous substitutions, alterations and modifications are all permissible without departing form the spirit and scope of the invention as defined in the following claims.

We claim:

1. A method of desulfurizing coal comprising the steps of:

suspending the coal in an aqueous medium consisting essentially of water to form a slurry;

chlorinating the coal slurry at a temperature below 130 degrees C. by bubbling chlorine gas into the slurry to form water soluble sulfur compounds; and separating the chlorinated coal from the aqueous medium.

2. A method according to claim 1 in which coal is present in the slurry in an amount from 15% to 60% by weight.

3. A method according to claim 2 in which coal is present in the slurry in an amount from 20% to 40% by weight.

4. A method according to claim 2 in which chlorine is added to the slurry in a stoichiometric ratio of 3.5–4.0 moles of chlorine per mole of sulfur.

5. A method according to claim 2 in which the coal has a particle size from 40 to 325 mesh.

6. A method according to claim 2 in which the temperature of the slurry is from 20 degrees C. to 100 degrees C. and the pressure is below 5 atmospheres during chlorination.

7. A method according to claim 6 further including the step of dechlorinating the separated coal to a chlorine content below 1% by weight.

8. A method according to claim 7 in which dechlorination is effected by heating the separated coal to a temperature of from 300 degrees C. to 500 degrees C.

9. A method according to claim 1 in which the coal contains an initial sulfur content of at least 0.2% by weight.

* * * * *